United States Patent [19]

Todd et al.

[11] 4,365,377

[45] Dec. 28, 1982

[54] FLOOR POLISHING MACHINE

[75] Inventors: Mike J. Todd, Eagan; Jeffrey A. Lee, Crystal, both of Minn.

[73] Assignee: H. B. Fuller Company, St. Paul, Minn.

[21] Appl. No.: 225,511

[22] Filed: Jan. 13, 1981

[51] Int. Cl.[3] ..... A47L 11/14

[52] U.S. Cl. ..... 15/98; 75/49 R

[58] Field of Search ..... 134/6; 15/49 R, 50 R, 15/87, 98, 180; 51/177, 170 T

[56] References Cited

U.S. PATENT DOCUMENTS

| | | | |
|---|---|---|---|
| 843,966 | 2/1907 | Sass | 51/177 |
| 1,591,682 | 7/1926 | Ponselle | 15/49 R |
| 3,550,179 | 12/1970 | Brown et al. | 15/98 X |

FOREIGN PATENT DOCUMENTS

| | | | |
|---|---|---|---|
| 77226 | 3/1918 | Switzerland | 15/49 R |
| 103622 | 3/1924 | Switzerland | 15/49 R |

*Primary Examiner*—Marc L. Caroff

*Attorney, Agent, or Firm*—Merchant, Gould, Smith, Edell, Welter & Schmidt

[57] ABSTRACT

An apparatus for polishing a floor includes a rotated polishing pad suspended from a housing with a mechanism for maintaining full engagement of the surface of the pad with the floor. This mechanism includes a caster disposed within a centrally-located aperture in the pad and a device, such as a spring, connecting the caster to the housing which increasingly urges the caster and housing away from one another as they progressively approach one another.

3 Claims, 3 Drawing Figures

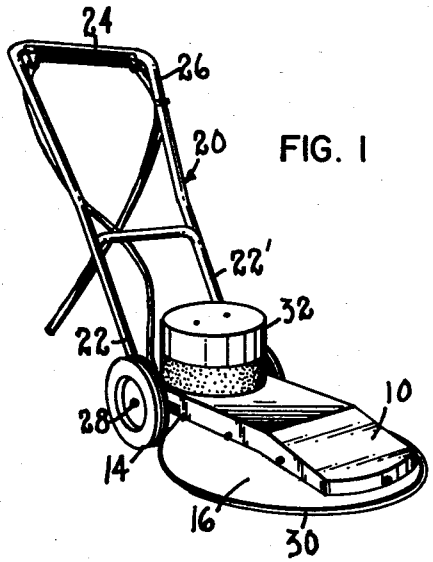
FIG. 1
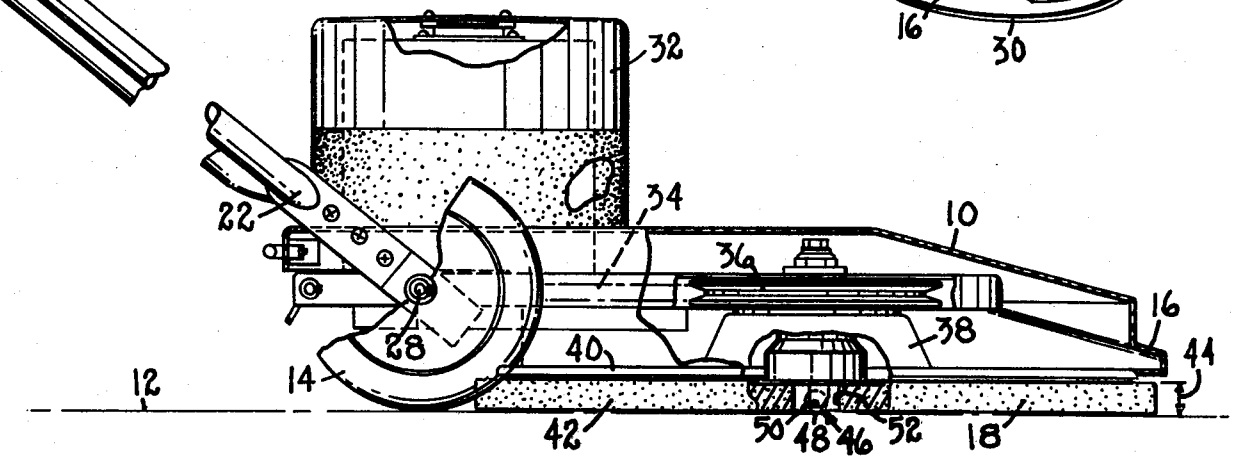
FIG. 2
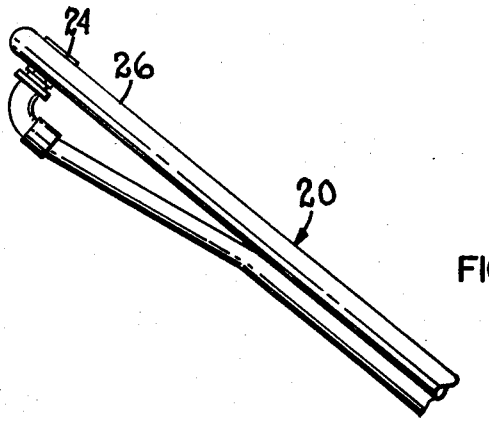

FLOOR POLISHING MACHINE

TECHNICAL FIELD

The invention of the present application relates generally to the field of floor polishers. More particularly, this invention relates to a floor buffing machine having a polishing pad, the full surface of which engages the floor being polished substantially at all times during operation of the machine.

BACKGROUND OF THE INVENTION

Floor polishers, and particularly polishers which are electrically operated, are known in the art and have been used for some time for polishing and buffing floors. Such machines are used particularly for commercial applications. Typically such machines include an operator's handle extending upwardly and rearwardly from a pair of mounting wheels. A machine housing having a buffing pad mounted for circular rotation about a generally vertically extending, centrally disposed axis extends forwardly from the mounting wheels.

In some prior art structures, the buffing surface of the pad defines a plane which is not tangent to the mounting wheels at their intersection with the floor surface. Consequently, with structures such as this, only a portion of the pad engages the floor.

Attempts have been made to effect and maintain full pad contact with the floor by positioning the pad so that its surface does define a plane which is tangent to the mounting wheels at their intersection with the floor. Frequently, however, the operator handle is disposed at a fixed angular relationship to the horizontal. For example, the handle may extend upwardly from the horizontal at an angle of 45 degrees thereto. As a machine of this type is being manuvered by its operator, a pushing motion upon the handle in a forward direction will cause the rearward edge of the pad to be lifted from the floor, to some extent, until the inertia of the machine is overcome.

In newer machines, attempts have been made to solve this problem by providing a handle which is pivotally mounted for movement about an axis about which the mounting wheels rotate. As the operator applies force to the machine by pushing it in a forward direction, some of the force is attenuated by the handle pivoting about the axis, and not as great a tilting movement is imparted to the buffing pad. Consequently, a greater percentage of the pad's surface will stay engaged with the floor than would if were the handle mounted at a fixed angle.

In all of the structures heretofore described, however, disengagement of at least a portion of the pad will occur, at least for a short period of time, to one degree or another. The consequences are the same in all cases but commensurate with the measure of pad disengagement with the floor. With full pad engagement, external forces on the machine are substantially equalized, and the machine will not tend to drift in any one direction. When, however, a portion of the pad, such as the rear portion thereof, becomes disengaged from the floor and elevated thereabove, a side torque will be applied to the machine, and it will tend to drift to one particular side.

When the machine tends to drift in one particular direction, more effort is required on the part of the operator of the machine to guide it where he desires. At low pad rotational speeds, the additional effort required of the operator may not be particularly significant. At high speeds, however, significant fatigue can be induced.

Additionally, when the load is not distributed throughout the full surface of the pad, the machine will tend to "chatter." This chattering, or vibration, causes uneven wear of the pad and additionally induces fatigue in the operator.

Finally, when full pad engagement is not effected, the machine will tend to draw large amounts of current. Draws in excess of 15 amperes are not uncommon with prior art machines.

It is to these deficiencies in the art that the invention in accordance with the present application is directed. It provides a structure which, as the machine is urged forward, resists raising of the rearward edge of the pad and maximizes full engagement of the buffing surface of the pad with the floor.

SUMMARY OF THE INVENTION

The present invention is a device for facilitating full pad surface engagement of the treating pad of a floor treating machine with a floor surface. The apparatus includes a member, such as a caster, for engaging the floor. The member is mounted proximate the treating pad and is disposed for vertical movement vertically toward and away from apparatus by which the pad is suspended within the machine. The member is biased away from the suspension means and toward the floor. When the pad is in engagement with the floor, a lower edge of the member is flush with the pad engagement surface. Since the treating pad is compressable, as the pad suspension means is caused to be moved downwardly, the pad compresses, and the floor engagement member moves upwardly relative to the suspension means. Compression means is mounted between the engagement member and the means by which the pad is suspended. As the pad mounting means is caused to be moved downwardly compressing a portion of the pad, the compression means exert progressively increasing force upon the suspension means to increasingly urge it back upwardly to a position wherein the pad is not compressed.

In certain embodiments, the engagement member can be disposed centrally with respect to the pad and be positioned in an aperture formed through the pad. The caster can be mounted at the bottom of a mounting strut for rotational movement. The strut can have an upwardly extending shank portion disposed for vertical sliding movement in a sleeve carried by the suspension means.

The compression means can comprise a helical spring disposed within the sleeve. An upper end of the spring can abut against an axial shoulder formed in the upper section of the sleeve, and the lower end can abut against an upper axial end of the strut. As downward pressure is exerted upon the suspension means, therefore, the strut will slide axially farther into the sleeve and compress the spring. Spring compression will, in turn, tend to urge the suspension means back upwardly so that equal pressure is exerted around the total surface of the treating pad.

The invention of this application thus is an apparatus for resolving problems extant in the prior art. Specific advantages of the invention will become apparent with reference to the accompanying drawings, detailed description of the invention, and claims.

BRIEF DESCRIPTION OF THE DRAWINGS

FIG. 1 is a view in perspective of a floor polishing machine in accordance with one embodiment of the present invention;

FIG. 2 is a side elevational view of the embodiment illustrated in FIG. 1, some portions thereof shown in section and some portions thereof broken away.

DETAILED DESCRIPTION OF THE INVENTION

Figure 3:
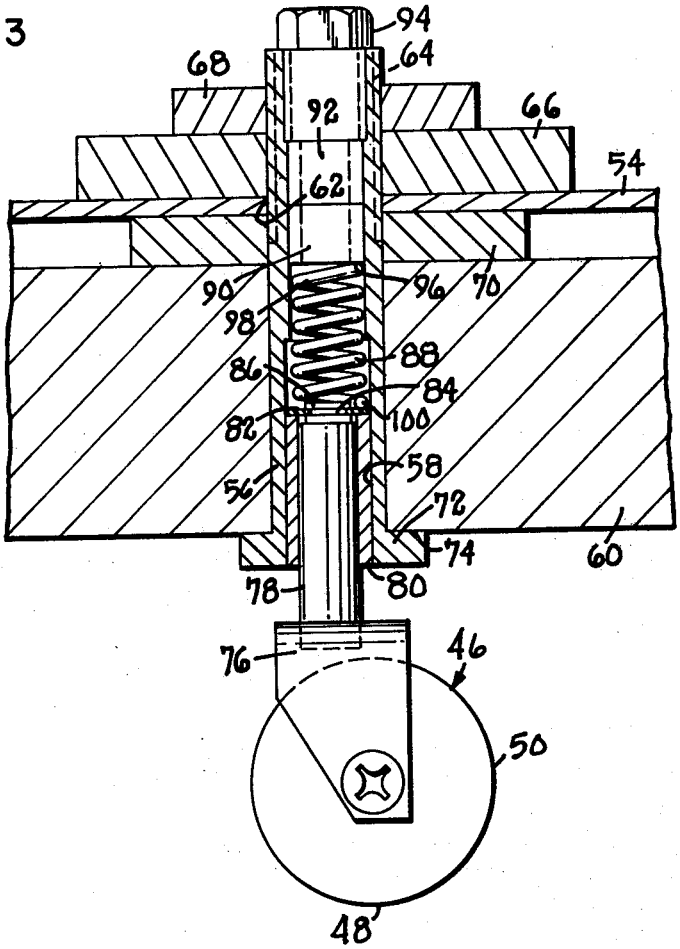
FIG. 3 is an enlarged side elevational view in section of the sleeve-received caster member.

Referring now to the drawings wherein like reference numerals denote like elements throughout the several views, FIG. 1 illustrates, in perspective, a preferred embodiment of the invention in accordance with the present application. The embodiment includes a housing 10 mounted for movement over a horizontal surface such as a floor 12. The housing 10 is supported for such movement by a pair of coaxial wheels 14 mounted rearwardly thereof. Extending downwardly from the housing 10, at a position forward of the wheels 14, is a generally disc-shaped shroud 16. The shroud 16 serves the function of protecting the user of the machine from a floor treating pad 18 mounted rotatably beneath the shroud 16.

The embodiment illustrated includes a handle 20 having a generally inverted U-shape. The first and second ends 22, 22' of the handle 20 are operatively connected to the housing 10 so that the user of the floor treating machine can propel the machine as desired. The handle 20 is provided with a grip 24 formed by a bail portion of the handle 20 intermediate the first and second ends 22, 22'. Longitudinally extending arms of the handle 20 can be interconnected mid-way along their length to provide additional support and rigidity to the handle 20.

The handle 20 can be made length adjustable by configuring it so that the bail portion 26 thereof can be disconnected from the ends 22, 22' of the handle 20 and be telescoped longitudinally with respect thereto. A plurality of holes (not shown) can be provided in each longitudinally extending member of the bail portion 26 and each of the ends 22, 22' of the handle 20. Particular holes in each of these members can be aligned and be maintained relative to one another by inserting a bolt or pin therethrough. The handle 20 can, thereby, be maintained as a rigid structure.

The ends of the handle 20 can be connected to the housing at an axis 28 about which the wheels 14 for supporting the housing 10 rotate. In certain embodiments, the handle 20 can be mounted for pivoting movement about this axis 28.

A treating pad 18 for polishing or buffing the floor 12 is mounted beneath the shroud 16. The pad 18 can be generally circular to conform to the shape of the shroud 16 illustrated in FIG. 1. The pad 18 would, of course, have a diameter slightly smaller than that of the shroud 16 so that the pad 18 would not protrude beyond the peripheral edge 30 of the shroud 18. It will be understood, however, that the shape of the buffing pad 18 is not essential to the invention, and shapes other than circular are specifically contemplated.

The pad 18 is driven rotatably about an axis extending generally vertically through its center. A motor 32 can be provided as a source of driving power. A shaft extending from the motor 32 drives a pulley about which is engaged a continuous belt 34. (Neither the motor shaft nor the pulley is shown.) The belt 34, in turn, extends about a second pulley 36 fixedly attached to a hub 38 extending upwardly from a pad attachment member 40. Rotational motion is, thereby, translated from the motor 32 to the pad 18. The pad 18 can be affixed to the attachment member 40 by any conventional means known in the art.

The pad 18 has a floor engaging surface 42. This surface 42, in the designed operational disposition of the machine, engages, across its full area, the floor surface which is being worked. That is, the surface 42 defines a plane tangent to the peripheral edges of the wheels 14 at points where the wheels 14 engage the floor 12. The pad 18 is so disposed so that the pressure exerted on the floor 12 by any point on the pad 18 is the same as that exerted by any other point on the pad 18. Such a relationship of the pad 18 to floor 12 is, of course, a relationship achieved only under optimum conditions, and, as the machine is accelerated forwardly, more pressure will tend to be exerted upon the floor 12 at the forward end of the pad 18.

The pad 18 is compressible in nature and will deform somewhat readily. It has a normal thickness as indicated at 44. As the polishing machine is accelerated forwardly, torque exerted upon the handle 20 by the machine's user will tend to pivot the front end of the housing 10 downwardly. Because of the compressable nature of the pad 18, this tilting will, to a degree, be permitted.

Means are provided for urging the housing 10 upwardly to its normal position so that the same pressure is applied to the floor 12 by any particular point on the floor engaging surface 42 of the treating pad 18. This means includes a floor engagement member 46 having a lower edge 48. The lower edge 48 is, at all times, maintained flush with the floor engaging surface 42 of the pad 18 while that surface 42 is in engagement with floor 12. This is true since the member 46 is positioned proximate the pad 18 and is biased downwardly in a manner to be described hereinafter.

As shown in FIG. 2, the floor engagement member 46 includes a caster 50 extending downwardly through a circular aperture 52, coaxial with the treating pad 18, formed therethrough. By so positioning the caster 50, it will give support equally to all points on the pad 18.

Referring now to FIG. 3, the caster 50 is shown as mounted within the aperture 52 formed in the treating pad 18. An upper wall 54 of the cowling, disposed over the pulley 36 which is driven to cause the pad 18 to rotate, is illustrated. This cowling, together with the housing 10, to which it is rigidly attached, forms part of the means by which the pad 18 is suspended. A sleeve 56 is inserted through the central aperture 58 through the inner-race 60 of a bearing and, thereafter, through an aperture 62 in the wall 54. The sleeve 56 can, at its upper end, be externally threaded, as indicated at 64 so that a nut 68 can be tightened down to secure the sleeve 56 to the cowling. The wall 54 of the cowling can be strengthened by overlying strongback 66.

As illustrated in FIG. 3, a spacer 70 can be inserted between the lower surface of the wall 54 and the upper surface of the inner-race 60. A lip 72 at the lower end of the sleeve 56 can, thereby, be made to engage the under surface 74 of the inner-race 60 to secure the sleeve 56 tightly to the cowling.

The outer race of the bearing can be in engagement with an inner diametrical surface of the driven pulley 36. As the pulley 36 is made to rotate, therefore, the rotational motion need not be translated to the sleeve 56.

The caster 50 is mounted for rotation at the bottom end of a mounting strut 76. The strut 76 includes an upwardly extending shank 78 which is slidably received within the lower end of the sleeve 56. A bearing 80 can be provided to insulate against friction between the shank 78 and the inner surface of the sleeve 56. The bearing 80 can have an outer diameter so that it can be pressfitted tightly into the sleeve 56.

A lock ring 82 can be seated on top of the bearing 80 to preclude withdrawal of the shank 78 of the mounting strut 76 therefrom. An annular groove 84 can be formed in the upper end of the shank 78, and the lock ring 82 can be received in this groove 84 to provide a stop against which a lip 86 formed at the upper extremity of the shank 78 can axially abut.

A compression element such as a helical spring 88 can be inserted within the sleeve 56 to bias the caster support strut 76 downwardly. Spacers 90, 92, as needed, can be inserted within the sleeve 56 on the top of the spring 88 to compress the spring 88 a degree in order to establish the biasing effect. The spacers 90, 92 are, in turn, held in place by a cap plug 94. The lower most spacer 90, thereby, forms an axial shoulder 96 for abutting one end 98 of the spring element 88. The other end 100 of the spring element 88 is abutted by the upper axial end of the shank 78. Spacers 90, 92 are inserted to ensure that some degree of compression of the spring 88 is incuded in order that the strut 76 be urged downwardly to a point where the lock ring 82 engages the upper end of the bearing 80. With the strut 76 in this position, the caster 50 sould extend somewhat below the floor engaging surface 42 of the treating pad 18 if the pad were not in engagement with the floor 12. With the pad 18 in engagement with a floor 12, however, upward force imparted to the caster 50 by the floor surface 12 will, to a degree, compress the spring 88.

As the polishing machine is manuvered by its operator and the front edge of the housing 10 is tilted downwardly, the spring 88 is compressed even further. In response to the spring compression, however, the cowling, and in turn the housing 10, is urged back upwardly immediately. The spring element 88 must, of course, be chosen to have the right characteristics so that the upward urging of the housing 10, is immediately responsive to downward tilting of its front edge.

Numerous characteristics and advantages of my invention has been set forth in the foregoing detailed description. It will be understood, of course, that this disclosure is, in many respects, only illustrative. Changes may be made in details, particularly in matters of shape, size, and arrangement of parts without exceeding the scope of the invention. The invention's scope is defined in the language in which the appended claims are expressed.

What is claimed is:

1. A floor polishing machine, comprising:

(a) a housing;

(b) a pair of coaxial wheels fixed positionally relative to, and rotatably attached rearwardly of, said housing, mounting said housing for movement over a horizontal floor surface, said wheels having peripheral edges engaging the horizontal surface as they rotate;

(c) a generally U-shaped movement imparting handle having first and second ends and a bail portion therebetween, each of said handle ends being operatively connected to said housing at the axis of said wheels;

(d) a compressible, circular polishing pad, said pad having a floor engagement surface for engaging the floor substantially along the engagement surface's total area and defining a plane generally tangent to said wheels at locations thereon engaging the horizontal surface, said pad further having a circular aperture, coaxial therewith, formed therethrough;

(e) means suspending said pad in a fixed position relative to said housing;

(f) means for driving said pad rotationally about a generally vertical axis through its center;

(g) a caster disposed in said aperture and for movement toward and away from said housing; and (h) means connecting said caster to said housing and for increasingly urging said caster and said housing away from one another as they progressively approach one another.

2. A polishing machine in accordance with claim 1 wherein said handle is connected to said housing for selective pivoting about the axis of said wheels.

3. A polishing machine in accordance with claim 1 wherein said handle is adjustable longitudinally so that said bail portion is selectively movable toward and away from said axis of said wheels.

* * * * *